United States Patent [19]

Resnick et al.

[11] Patent Number: 5,021,042

[45] Date of Patent: Jun. 4, 1991

[54] DIE CUTTING APPARATUS WITH IMPRESSIBLE COATING

[75] Inventors: Michael Resnick, Niles; Walter Saebeler, McHenry, both of Ill.

[73] Assignee: X-Print, Inc., Morton Grove, Ill.

[21] Appl. No.: 578,742

[22] Filed: Sep. 6, 1990

Related U.S. Application Data

[63] Continuation-in-part of Ser. No. 271,629, Nov. 15, 1988, Pat. No. 4,955,855.

[51] Int. Cl.[5] ..... B31B 1/20

[52] U.S. Cl. ..... 493/404; 493/59; 76/107.8

[58] Field of Search ..... 76/107.1, 107.8; 493/404, 396, 58, 59, 61, 62, 73, 74, 372

[56] References Cited

U.S. PATENT DOCUMENTS 4,256,026 3/1981 Marbach ..... 493/404

4,326,434 4/1982 Mohr et al. ..... 76/107.8

*Primary Examiner*—Roscoe V. Parker

[57] ABSTRACT

There is disclosed herein an apparatus for forming container blanks from cardboard or other paperboard-like substrates. The apparatus includes a press, platens, a coated plate member, and a die-and-knife assembly. The coating on the plate is impressible for accommodating irregularities in the machine, platen surface, or knife so as to permit the knife edges to substantially lie in a cutting plane. The coating is generally an organic coating which is liquid just above room temperature and solid at room temperature. The impressions are made in the coating and the coating is then hardened for use by polymerization such as by ultraviolet light.

27 Claims, 2 Drawing Sheets

DIE CUTTING APPARATUS WITH IMPRESSIBLE COATING

CROSS-REFERENCE TO RELATED APPLICATION

This application is a continuation-in-part of prior application Ser. No. 271,629 filed Nov. 15, 1988, and now U.S. Pat. No. 4,955,855 in which we are co-inventors.

BACKGROUND OF THE INVENTION

The invention herein relates to the cutting and scoring of cardboard and paper or other materials, and more particularly, to a coated plate for use in uniformly positioning a cutting knife or scoring tool with respect to a sheet to be cut into a blank.

For instance in the manufacture of three-dimensional cardboard containers, such as for medications and the like, a two-dimensional cardboard sheet is cut and scored to form a "blank". The blank is folded along various score and cut lines to achieve the desired three-dimensional or box-like shape.

The sheet is cut and scored by feeding the sheet into a press which usually carries a movable lower platen and a stationary upper platen to which a die-and-knife assembly is secured. The die which has the blank outline therein is usually secured to the stationary platen but may be secured to the movable platen. The cutting knife is positioned in slots or openings in the die which are specifically cut therein to hold the cutting knives or other similar tools. The press is closed to cut and score the sheet and then opened to remove the cut blank.

The knives and scoring tools (elongated band-like elements that have an exposed sharp or working edge) extend through the die and abut at their back end against a back plate, which in turn abuts a platen. The platen surface, behind the die, may be irregularly shaped, and it is usually necessary to "shim" the knife by inserting a paper shim between the back plate and platen so that the cutting edges of the knife lie in a plane. This is usually tested by cutting a sample and determining if the edges have cut uniformly. The shimming operation has been expensive, timeconsuming, an art rather than a science, and since the paper may change or be unstable with the number of impressions, the alignment may also change.

One approach to solving these problems has been to provide a knife with a softened back edge which is intended to rest against the hard platen and in a sense self-adjust or conform to the platen irregularities. One such system is disclosed in U.S. Pat. No. 4,256,026. However, this system still requires knife positioning adjustment to assure even cuts, it has too limited a range of automatic adjustment and it subjects the exposed machine parts to damage.

It is therefore the object of this invention to provide an efficient knife or tool adjustment for use in cardboard paper or other material cutting and scoring.

This and other objects of this invention shall become apparent from the following description and appended claims.

SUMMARY OF THE INVENTION

An adjustment system is provided for blank formation in which an impressible coating is applied to a plate secured to a platen, and the back edge of a knife or die assembly pressed thereagainst so as to mate and form an impression. The coating is then hardened. The surface behind the die assembly is thus "adjusted" and the system is ready for use commercially. In use, irregularities have been accommodated in the impression step so that numerous blanks can be uniformly fabricated. This system has saved make-ready time, minimized rejection or maximized a high rate of repeatability and yielded a two to three times longer life for the cutting knife.

The system can also be used by applying a spot sheet to the back plate and the impressible coating thereover so as to adjust the knife by use of both the spot sheet and the impressible coating.

In this system an organic coating which can be liquid when heated is applied to or cast on the plate and then solidified. The plate is then positioned in the press. The impression is made and then the coating is hardened or cured as, for example, by polymerization under ultraviolet exposure. A suitable class of organic materials is disclosed in U.S. Pat. No. 4,078,015 to Leitheiser et al. Other castable, impressible and durable materials can be used.

The process deals with the application of a material, usually a polymerizable organic to a plate, interposing this plate between the knife and the platen, impressing the coating, and then polymerizing the material to a hardened or cured state for actual use.

The hardened material has a hardness of at least about 90–100 Shore durometer A. For handling purposes, it is desirable that the coating is done above room temperature, impressing at about room temperature, and the hardening at about room temperature.

DESCRIPTION OF THE PREFERRED EMBODIMENT

Figure 1:
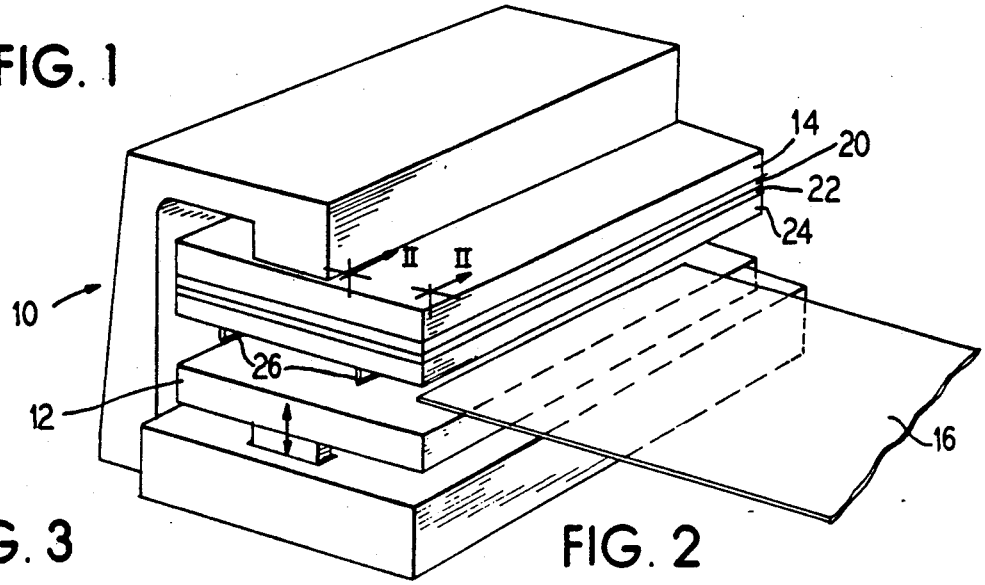
FIG. 1 is a perspective and diagrammatic view of a set up for stamping a cardboard box blank from a cardboard sheet.

Referring now to FIG. 1, there is shown schematically a press or stamping apparatus 10. The apparatus includes a movable platen 12 in the lower position. The upper member 14 is usually a stationary platen 14. The movable platen 12 is movable toward and away from the stationary platen 14. It is appreciated that the positions of the stationary and movable platens can be reversed.

Figure 3:
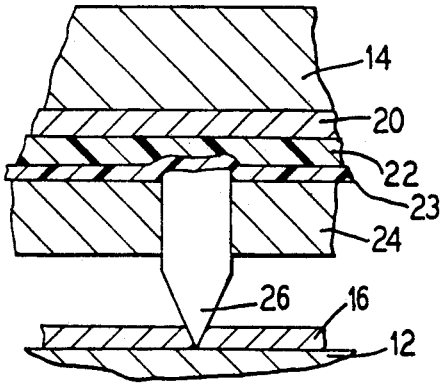
FIG. 3 is a sectional view like FIG. 2 and showing a resilient sheet inserted between the coated plate and knife.
Figure 2:
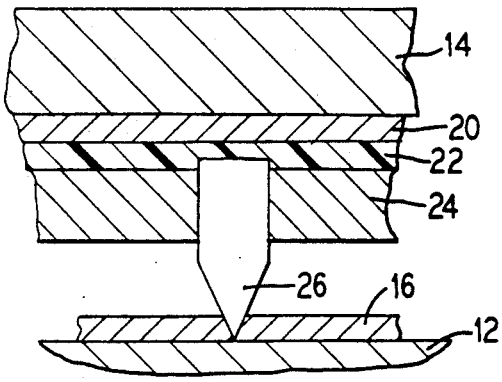
FIG. 2 is a sectional view along lines II—II of FIG. 1 showing the movable plate, coated plate, die and knife in greater detail.
Figure 4:
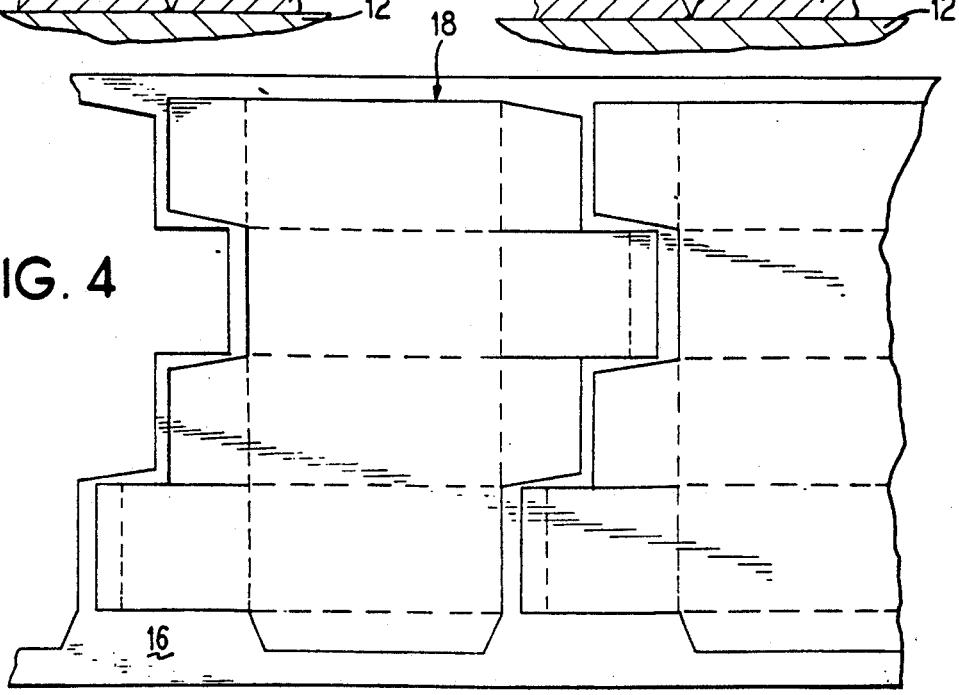
FIG. 4 is a plan view of a die cut sheet.

A sheet of cardboard 16 is movable into a position between the platens for cutting and forming into a blank such as 18, as shown in FIG. 3. Movement of the sheet 16, timing of the opening and closing of the platens, and removal of a blank 18 is known in the art.

In order to properly cut and form the sheet into the blank, the upper or stationary platen carries a plate 20, that has been coated with an impressible coating 22. A die 24 is also carried on the stationary platen 14. The die is cut to receive and carry a cutting knife and scoring tool 26. The stationary platen 14, coated plate 20, and knife 26 are arranged such that the uncoated face of plate 20 rests against the platen and the knife 26 rests against the coated plate. Thus the back edge of a knife can engage the impressible coating.

In order to effectively cut box blanks, it is necessary to "make-ready" the machine, which means placing the knife in a repeatable cutting position. This is done by seating the back edge of the knife 26 against the coating 22. The back edge of the knife, the platen 14, and other parts of the machine may be irregular. Thus the cutting edge of the knives, such as 26, do not necessarily lie in the same plane. Thus by forming an impression in the coating, it permits the knife to lie in the same plane.

Attempts to reduce the set-up time have been made by providing soft back edges to the knife as suggested in U.S. Pat. No. 4,256,026. But this cannot compensate enough for discrepancies which presently exist. They also cause back plate damage.

In this invention it has been discovered that selected coatings in a soft state can be applied to a plate and impressions made in the coating which effectively accommodate for the plate and knife and platen irregularities. To set the impression, the coating is then cured and hardened and the coated plate is ready for production. This procedure has substantially reduced the "make-ready" time. Factors of time reduction on the order of seventy-five percent or more are not unusual.

In addition, it has been found that in some situations an elastomeric sheet (such as polyurethane) approximately 0.012 inch is placed between the hardened coating and the die back to guard against inadvertent knife damage. The elastomeric sheet is shown in FIG. 3 by reference numeral 23.

In general, the coating can be conceived of as having a two-step process. The first step is melting the coating material at above room temperature and casting it onto a plate, and then solidifying the same. The plate is then distributed to the field. In the field the plate is inserted into the machine and impressions are made to achieve levelling.

Then the material is then hardened in which the hardening is a result of polymerization activated by gamma radiation, UV radiation, electrical high voltage, such as electron beam, or the like. These are non-heat types of treatment.

Materials meeting the foregoing criteria are generally satisfactory since they provide a suitable, impressible coating which can be hardened so as to replicate the impression.

Materials which are suitable for use include acrylics, styrenes, vinyls such as methyl, ethyl or butyl, polyolefins, such as polyethylene, polypropylene, and polybutylene, along with mixtures of a copolymer. Such copolymers include polyurethanes which will soften on heating and isocyanates such as glycol. Generally speaking, simple mixtures will be suitable. Various additives and fillers can be added to the material.

It is understood that one or more polymers can be selected from the group of acrylics, styrenes, vinyls and polyolefins. The coating is usually hardenable to a minimum of 90–100 Shore durometer A. Curing is by polymerization. The coating is usually at least 0.020 inch or 0.5 micrometers thick.

In practice, materials from Freeman Chemical Corporation, Port Washington, Wis. as shown in U.S. Pat. No. 4,078,015 can be used. Generally these materials are defined, in the Summary of the Invention as:

"The present copolymerizable mixture can be maintained as a polymerizable liquid at temperatures in the range of 50°–120° C., preferably about 75°–100° C. Above about 120° C. the composition will commence to gel as a consequence of heat alone. The composition can be handled, poured, shaped as a liquid and allowed to cool and harden to a pliable solid at room temperature without experiencing polymerization. Thereafter the composition can be cured when exposed to ultraviolet radiation so long as a suitable ultraviolet photo-initiator is included in the mixture.

"The two ingredients of the copolymerizable mixture are (I) 10 to 50 parts by weight of an acrylate diurethane polymer substantially free of unreacted—NCO groups and (II) 90 to 50 parts by weight of a polyacrylate polyurethane monomer formed by combining a betahydroxy alkyl acrylate with a polyisocyanate and a polyol. Adjusting the proportion of acrylate diurethane monomer (I) to the polyacrylate monomer (II) provides a means for determining the hardening temperature of the composition. Proper selection of the polyisocyanate and the polyol ingredient of the polyacrylic polyurethane monomer (II) provides a means for regulating the brittleness or resiliency of the hardened polymerizable composition.

"There are two alternative methods proposed for preparing the present compositions in situ where both of the monomers I and II are formed from a diisocyanate. The beta-hydroxy alkyl acrylate is combined mol-for-mol with the diisocyanate to produce a first intermediate product which is a monoacrylicmonourethane, isocyanate-terminated adduct. A sufficient amount of polyol is added to this intermediate product to produce the desired quantity of the polyacrylic polyurethane monomer. Thereafter the residual first intermediate product is capped with a mono-hydroxy compound, such as phenol or a lower alkyl alcohol. Methanol is preferred. The reactants are combined such that the resulting polymerizable composition is substantially free of unreacted isocyanate groups and unreacted hydroxy groups. The polyisocyanate preferably is toluene diisocyanate or some other diisocyanate such as phenylene diisocyanate; diphenyl methane diisocyanate; dicyclohexylmethane diisocyanate; xylidene diisocyanate; isophorone diisocyanate; lysine diisocyanate; hexamethylene diisocyanate.

"The mono-hydroxy compound which is utilized for capping the residual first intermediate produot may be at least in part a hydroxy alkyl ester of a carboxylic acid and specifically a beta-hydroxy ester of an acrylic acid which provides some diacrylate diurethane monomers in the resulting composition.

"The beta-hydroxy alkyl ester of acrylic acid may be hydroxy-ethyl acrylate (HEA), hydroxy ethyl methacrylate (HEMA), hydroxy propyl acrylate (HPA) and hydroxy propyl methacrylate (HFMA). The preferred capping mono-hydroxy compound is methanol.

"The preferred polyol for forming the polyacrylic polyurethane monomer is the hydroxy terminated polyester of adipic acid and diethylene glycol. Other hydroxy terminated polyesters also are useful such as: a polycaprolactone diol; polyesters formed by reaction of a dicarboxylic acid or acid anhydride with a glycol or with an alkylene oxide adduct of a glycol. Phthalic acid, isophthalic acid, adipic acid, maleic acid, oxalic acid, malic and succinic acid, itaconic acid, citraconic acid, and the like can be combined with glycols such as ethylene glycol, propylene glycol, butylene glycol, diethylene glycol, dipropylene glycol, dibutylene glycol, neopentyl glycol, alkylene oxide adducts of bisphenols, and the like. The polyol may be a polyalkylene oxide adduct of a glycol, such as polypropylene glycol.

"While the compositions contain from 10 to 50 parts by weight of the acrylate, diurethane monomer and 90 to 50 parts by weight of the polyacrylate polyurethane monomer, the preferred compositions include from about 15 to 30 parts by weight of the acrylate, diurethane monomer and from 85 to 70 parts by weight of the polyacrylate, polyurethane monomer."

The method of the Freeman patent is more generally set forth in claim 6 of that patent.

EXAMPLE

More specifically, Freeman Chemical Co. material Chempol 019-A682-67 urethane acrylate photocurable polymer is used as a starting material.

This material is a solid which is photo sensitive to light at about 350 nanometers, this can be UV, sunlight or fluorescent, but not incandescent. This material is then remelted in an oven at 180° F. to a liquid. The liquid is cast onto an aluminum substrate, which is then cooled to room temperature as a solid. The material is about 0.020 inch thick. The plate is then cut to size. The plate is then fitted into the press and an impression struck. The material is withdrawn from the press and subjected to UV light at about 350 nanometers 6"×6"×40 W fluorescing tube radiation.

This polymerizes the coating. The coating can then be characterized as thermoset. This coating is stable to humidity and temperature, physically stable and has a hardness of at least 95 Shore A durometer. When the coated plate is refitted to the press, the press is ready for production.

Figure 5:
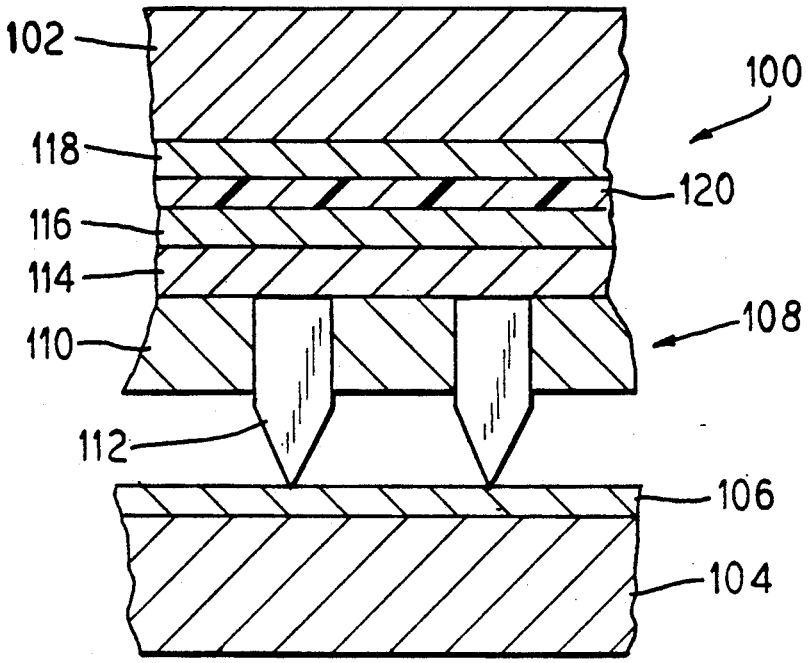
FIG. 5 is a sectional view of a system using an impressible coating wherein a steel die sheet is used during the impression stage.
Figure 6:
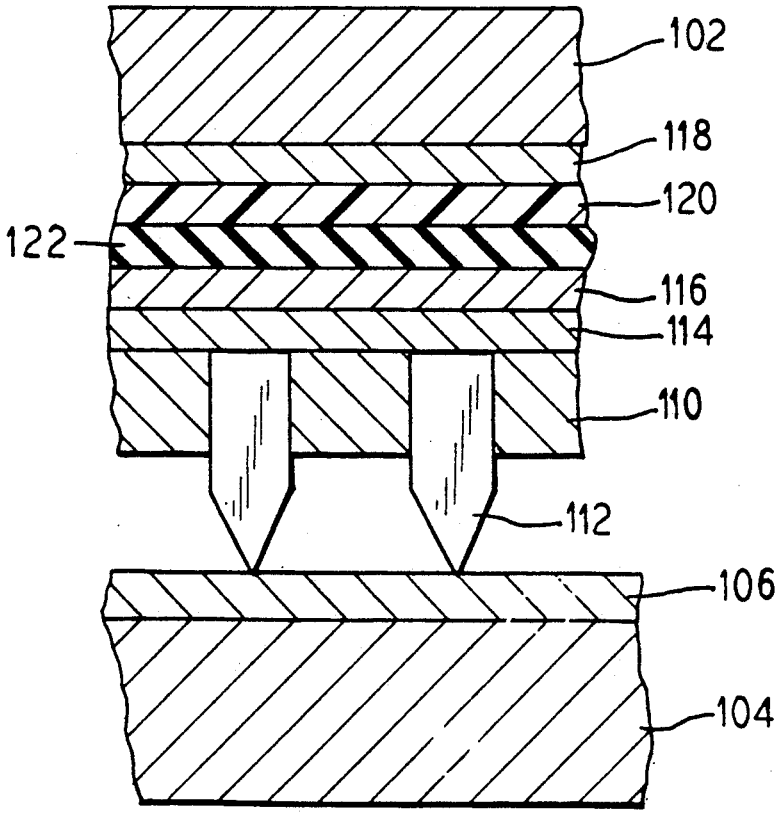
FIG. 6 is a sectional view of the system after the impressible coating has been hardened and the elastomeric sheet inserted.

FIGS. 5 and 6 disclose another embodiment. In FIG. 5, there is shown an embodiment which uses a die backing sheet or plate and a spot paper sheet and is in the prehardening make-ready state. FIG. 6 shows the use of the die backing and the spot sheet but with the coating in the hardened state ready for operation.

Referring first to FIG. 5, there is shown a press 100 generally having an upper stationary platen 102 and lower movable platen 104. The lower platen 104 carries the cardboard 106 to be cut. The knife carrying die assembly 108 includes a cut-out wood form 110 that carries knives 112 and which has a steel die backing sheet 114 against which the back edges of the knives bear. Sheets of spotting paper, such as 116, can be selectively applied to the backing plate 114 to initially level or macro adjust the levelness. Between the spotting paper 116 and the platen 102 is positioned the aluminum backing 118 with the impressible coating 120 thereon with the aluminum backing positioned against the platen and the coating against the spot sheet. The press is closed and the impression is made. Thereafter, the coated sheet is removed and hardened.

Referring now to FIG. 6, the hardened coated sheet 118 is replaced in the press. In addition, an elastomeric sheet 122 is inserted between the hardened sheet 118 and the spot paper 116.

For protective reasons the UV-selective coating is wrapped in an opaque material at least during shipment so as to avoid inadvertent hardening.

Although the invention has been described with respect to preferred embodiments, it is not to be so limited as changes and modifications can be made which are within the full intended scope of the invention as defined by the appended claims.

We claim as our invention:

1. A method of die cutting a sheet into a blank using a machine having movable and stationary platens associated therewith, and a tool-carrying die assembly associated with one of said platens, said tool carrying die assembly including a slotted die, tools positioned in the die, and a die backing plate comprising the steps of:

casting a liquid onto a plate;

solidifying said liquid into a coating having the characteristics of being impressible so as to form an impression and hardenable so as to harden said coating and retain an impression;

positioning said coated plate in said machine between the tool-carrying die assembly and the associated platen;

selectively positioning spotting paper means between the die assembly and coated plate;

impressing said coating with the die assembly and spotting paper means so as to adjust for irregularities between the tool and platen and so as to assure uniform cutting of the sheet to a blank, by moving one of said platens toward the other so that the working end of the tool engages the other platen and the irregularities between the tool and the platen are adjusted for by the coating;

removing the coated plate from the machine;

hardening the coating;

returning the hardened coating to said machine in substantially the initial impression position;

positioning an elastomeric sheet between the hardened coating and die assembly; and thereafter die cutting sheet stock into blanks.

2. A method as in claim 1, wherein said sheet stock is a paper-based material.

3. A method as in claim 1, wherein said coating is castable at a temperature near but above about ambient temperature.

4. A method as in claim 1, wherein said coating is an organic material.

5. A method as in claim 4, wherein said organic material is hardenable by polymerization.

6. A method as in claim 5, wherein said polymerization is by exposing said coating to ultraviolet radiation.

7. A method as in claim 1, wherein said tool is a knife having a cutting end which is adjusted so that its cutting end lies in a cutting plane.

8. A method as in claim 1, wherein said hardened coating has a hardness of at least 95 durometer Shore A.

9. A method as in claim 1, wherein said initial coating has a thickness of at least 0.020 inch thick.

10. A method of preparing for die cutting a sheet into a blank using a machine having movable and stationary platens associated therewith and a tool-carrying die assembly associated with one of said platens, which assembly includes a slotted die, tools positioned in the die, and a die backing plate comprising the steps of:

providing a plate having thereon a solidified coating characterized by being impressible so as to form an impression and hardenable so as to harden said coating and retain an impression;

positioning said coated plate in said machine between the tool-carrying die and the platen;

selectively positioning spotting paper means between the die assembly and coated plate;

impressing said coating with the die assembly and spotting paper means so as to adjust for irregularities between the tool and platen so as to assure uniform cutting of the sheet to a blank, by moving one of said platens toward the other so that the working end of the tool engages the other platen and the irregularities between the tool and the platen are adjusted for by the coating;

removing the coated plate from the machine;

hardening said coating;

returning the hardened coating to said machine in substantially the initial impression position;

positioning an elastomeric sheet between the hardened coating and die assembly; and thereafter die cutting sheet stock into blanks.

11. A machine for die cutting a paperboard-like sheet into a blank, said machine comprising:

a frame;

a stationary platen carried in said frame;

a movable platen carried on said frame and movable toward and away from said stationary platen;

a die-and-knife assembly associated with one of said platens, which assembly includes a slotted die, tools positioned in the die and a die backing plate;

wherein the improvement comprises there further being provided:

adjustment means positioned between the die-and-knife assembly and associated platen for adjusting the knife with respect to the associated platen so as to accommodate irregularities in the knife back edge, platen surface and machine, said adjustment means comprising:

a plate for engaging said platen; and a coating on one side of said plate for engaging the die-and-knife assembly, which coating has an impression shaped to conform to a previously made impression, is hardened, has a thickness of at least 0.020 inch and a hardness of at least 95 Shore durometer A; and an elastomeric sheet is positioned between the coating and the die-and-knife assembly.

12. A machine as in claim 11, whereby there is provided spotting paper means positioned adjacent the die-and-knife assembly and between the die-and-knife assembly and the elastomeric sheet.

13. A machine as in claim 11, wherein the tool carrying die assembly includes a die form that includes tool-receiving grooves and a metal backing plate that engages the die and an edge of the tool on one side and can engage the elastomeric sheet.

14. A machine as in claim 13, wherein said metal backing plate for said die plate includes a plurality of paper spot sheets for accommodating for irregularities.

15. A machine as in claim 14, wherein said backing plate and spot sheets are arranged to engage the elastomeric coating.

16. A machine as in claim 15, wherein said backing plate is positioned to engage said elastomeric sheet.

17. A machine as in claim 11, wherein the tool carrying die assembly includes a die form that includes tool-receiving grooves and a metal backing plate that engages the die and an edge of the tool on one side and can engage the unhardened coating and the elastomeric sheet.

18. A machine as in claim 17, wherein said metal backing plate for said die plate includes a plurality of paper spot sheets for accommodating for irregularities.

19. A machine as in claim 18, wherein said backing plate and spot sheets are arranged to engage the unhardened impressible coating.

20. A machine as in claim 19, wherein said backing plate is positioned to engage said elastomeric sheet.

21. A kit for use in a die cutting press to render tools carried in a die assembly level with respect to a sheet-carrying platen so as to enhance blank formation from the sheets, which kit comprises:

at least one photo polymer plate comprising a a metal backing and an impressible and hardenable polymeric compound coated thereon for forming an impression of the tool-carrying die and hardening by photo polymerization; and at least one elastomeric sheet for positioning between the tool-carrying die and a hardened photopolymerizable coating.

22. A kit as in claim 21, wherein said coating is coated onto the backing plate at a temperature near but above about ambient temperature.

23. A kit as in claim 22, wherein said coating is an organic material.

24. A kit as in claim 23, wherein said coating is hardenable by polymerization.

25. A kit as in claim 24, wherein said polymerization is by exposing said coating to ultraviolet radiation.

26. A kit as in claim 25, wherein after polymerization and hardening the coating has a hardness of at least 95 durometer Shore A.

27. A kit as in claim 21, wherein said coated plate and elastomeric sheet are wrapped in light resistant material to prevent visible radiation from exposing said coated plate.

* * * * *